US006457409B2

(12) United States Patent
Fujimoto

(10) Patent No.: US 6,457,409 B2
(45) Date of Patent: Oct. 1, 2002

(54) SHEET GUIDE UNIT FOR SHEET-FED PRESS

(75) Inventor: Shinichi Fujimoto, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/779,509

(22) Filed: Feb. 9, 2001

(30) Foreign Application Priority Data

Feb. 10, 2000 (JP) ..... 2000-033826

(51) Int. Cl.[7] ..... B41F 25/00
(52) U.S. Cl. ..... 101/232; 101/177
(58) Field of Search ..... 101/136, 141, 101/142, 177, 217, 232; 271/195

(56) References Cited

U.S. PATENT DOCUMENTS 4,384,524 A * 5/1983 Simeth et al. ..... 101/232
5,687,964 A * 11/1997 Stephan et al. ..... 271/195
5,816,155 A * 10/1998 Stephan ..... 101/232

FOREIGN PATENT DOCUMENTS

DE 19728104 A1 * 1/1999 ..... B41F/21/00
DE 59801939 G * 12/2001 ..... B41F/21/00
EP 1084833 A1 * 3/2001 ..... B41F/21/00
JP 10-109404 4/1998

* cited by examiner

*Primary Examiner*—Daniel J. Colilla
(74) *Attorney, Agent, or Firm*—Crowell & Moring LLP

(57) ABSTRACT

This invention concerns a sheet guide unit which allows sheets of thinner sheets to be conveyed in a stable fashion when the sheet is conveyed in a sheet guide space between the printing cylinder and a sheet guide surface. The sheet guide unit has 1) a first air control means to control the supply air, which is blown from the air supply chamber through air vents provided in the upstream portion of the path, and conveys the sheet through the sheet guide space suspending over the downstream portion of the path; and 2) a second air control means to control the aspiration air, which is drawn into the aspiration chamber via a plurality of first aspiration vents in the downstream portion of the path, and exhausted from an aspiration port provided on one of the walls of the aspiration chamber.

20 Claims, 7 Drawing Sheets

SHEET GUIDE UNIT FOR SHEET-FED PRESS

BACKGROUND OF THE INVENTION

1. Field of the Invention

This invention concerns a sheet guide unit in a sheet-fed press in which the sheet to be printed is fed through a space between the surface of the printing cylinder and a sheet guide unit which directs the sheet along the surface of the cylinder. A stream of air is blown through the space to generate the Bernoulli effect, which causes the sheet to be suspended above the surface as it traverses the space.

2. Description of the Related Art

Multiple-color sheet-fed presses which employ a series of printers each of which prints a different color ink are well known in the prior art. As can be seen in FIG. 9, the basic structural elements of such presses are feeder unit A, which consists of feeder device 39; printer unit B, which has four printers, 132*a*, 132*b*, 132*c* and 132*d*, arrayed in tandem to print cyan, magenta, yellow and black; and delivery unit C, here paper delivery unit 04.

In multiple-color sheet-fed presses with this configuration, a sucker unit with an inlet for sheets 11, which are piled on table 141 of the feed unit 39, separates a single sheet and transports it on conveyor 120. Swing gripper 121*a* delivers the sheet to intermediate cylinder 121*b* of printer 132*a*. The sheet is fed between blanket cylinder 22*a* and impression cylinder 23*a*, and the first color is printed.

Once the first color has been printed, the sheet is fed out between the blanket cylinder 22*a* and impression cylinder 23*a* and taken up by intermediate cylinder 27*a* of the second printer 132*b*. From the intermediate cylinder 27*a*, the sheet is delivered to impression cylinder 23*b*. The next process, the printing of the second color, is executed by blanket cylinder 22*b* and impression cylinder 23*b*.

The subsequent colors are printed one after the other. When sheet 11 is fed out between blanket cylinder 22*d* and impression cylinder 23*d*, which perform the final-stage printing, it is pulled onto delivery cylinder 35 of delivery unit C. From delivery cylinder 35, the now completely printed sheet 11 is taken onto chain conveyor 124 and transported to delivery unit 04, where it is added to the stack on table 40 of the unit 04.

Generally, the sheets 11 which are printed in a sheet-fed press are of a thickness which ranges from 0.04 m/m to 0.8 m/m. At times, high-rigidity sheets of metal plate or synthetic resin might also be printed. As the sheet is fed from printer 132*a* to printer 132*b* to print the various colors, various mishaps may occur. A thin sheet of paper will generally have low rigidity, and its rear portion will tend to flap. A thicker sheet of paper or sheet metal will have high rigidity, and its reaction force (stability) against the centrifugal force of rotation and its own curvature will cause its rear portion to separate from impression cylinder 23, and collide with the sheet guide unit 1 below the cylinder causing the paper to rebound.

When the paper flaps or rebounds in this way, the print may be smudged or the paper folded or torn. This phenomenon is a significant cause of a reduction in print quality. Two typical methods employed to counteract this problem are to use a skeleton cylinder or a drum cylinder for the intermediate cylinder 27. This allows the most appropriate scheme to be used for the rigidity of whatever sheet is being printed.

The example shown in FIG. 10 is a skeleton-type intermediate cylinder 27, which is used primarily when printing thicker sheets of paper. One of these skeleton cylinders 27 is placed on each side of each printer 132. Each skeleton cylinder consists of a pair of rotors (arms) 271 which rotate on axis 270. Each arm 271 has a series of pawls 29 on its shaft 272 (see FIG. 11 (A)) running from the end of arm 271 to the end of arm 271 on the opposite side of the shaft. The distinguishing feature of the skeleton cylinder 27 is that the area of the cylinder which comes in contact with impression cylinder 23 when the paper passes between them is extremely small. The sheet 100 which is being rotated forward is allowed to bend beyond point P where it comes into contact with pawls 29. In other words, the point of contact P becomes the point of action. By lengthening the distance from this point to the end of sheet 100, we reduce the reactive force exerted by the sheet in its attempt to return to its original shape.

As a result, we reduce the amount of rebounding at the end of the sheet which strikes sheet guide unit 1', the curved guide which conforms to the hypothetical circumference of the lower portion of skeleton-type intermediate cylinder 27. This scheme minimizes tears and folds; but on the other hand, because this sort of skeleton cylinder 27 provides a larger region in which the end of sheet 100 is free, a thin sheet will have more opportunity to flap.

The feature which distinguishes drum-type intermediate cylinder is that the amount of its surface area which comes in contact with impression cylinder as sheet is fed between them is maximized. Because the portion of sheet which is beyond pawls is guided along the circumference of the drum cylinder, this scheme makes it very difficult for the end of the sheet to flap, so it minimizes doubling, tearing and other defects resulting from the end of the sheet wrinkling or flapping. However, when this sort of drum cylinder is used to convey thicker varieties of paper, the fact that there is very little area where the end of the sheet is free will result in significant rebounding.

In recent years, as print quality has improved, there has been a tendency to use the skeleton cylinders even for thinner papers. To keep thin sheets from flapping, a sheet guide unit 1 is provided which has a sheet guide surface Id following the contour of the lower portion of intermediate cylinder 27 (or 27') and delivery unit 35 (hereafter referred to as the intermediate cylinder). In order to address the problems in this sort of sheet-fed press, a sheet guide unit is provided in which specifically pressurized air is blown through a number of vents in the sheet guide unit into the space between intermediate cylinder 27 and surface Id of the sheet guide unit. This air is blown along the bottom of sheet 11 as it passes through the space along sheet guide surface id. Because of the Bernoulli effect, the air blown through the vents causes the sheet 11 to be suspended.

One such sheet guide unit is described in Japanese Patent Publication (Kokai) Hei 10-109404. We shall explain the relevant technology with reference to FIG. 10 and FIG. 11. The sheet guide unit, which runs along the circumference of skeleton-type intermediate cylinder 27 or delivery cylinder 35, both of which are studded with pawls 29, consists of air ducts 06. On the upper surface of the air ducts 06 are numerous air vents 4*a* and 4*b*. The vents 4*a* and 4*b* face in opposite directions and are located on either side of the center of the intermediate cylinder 27 or of delivery cylinder 35. The vents distribute the air toward the outer edges of the intermediate cylinder 27. The vents 4*a* and 4*b* produce two streams of air which originate at the vents and continue to move in the directions determined by the vents. These air streams keep the sheet of paper 11 suspended at a specified height, thus stabilizing the travel of the sheet.

In the prior art technique, then, air is blown through a space between sheet guide surface 1*d* and the intermediate cylinder underneath sheet 11. The sheet is caught on pawls 29 of skeleton-type intermediate cylinder 27, the type of cylinder used for thicker papers. The air is blown into the space from ducts 06 below the guide surface through the air vents 4*a* and 4*b*. The Bernoulli effect which results from the differential flow rate above and below the sheet causes the sheet 11 being conveyed around the circumference of the intermediate cylinder 27 to be pulled toward surface 1*d* of the sheet guide unit and to be suspended slightly above that surface as it is conveyed until it is delivered to the subsequent impression cylinder 23.

However, in this prior art technique, when the sheet exits the guide space and is released from the pawls of the skeleton cylinder, there is nothing to hold it. And particularly if the sheet is thin, the Bernoulli effect due to the flow velocity of the air stream will not be sufficient to stabilize the end of the sheet.

When a sheet of a thinner stock is to be conveyed along a skeleton-type intermediate cylinder 27, the end of the sheet will inevitably flap or flutter in the downstream portion of the sheet guide. This may result in a variety of imperfections, including wrong positioning, overprinting, or crumpled or torn paper.

SUMMARY OF THE INVENTION

In view of these problems in the prior art, the object of this invention is to provide a sheet guide unit which allows sheets of thinner stocks to be conveyed in a stable fashion, and allows these sheets to be conveyed smoothly even when a skeleton cylinder, which is better suited to thicker stocks, is used. The sheet guide unit for a sheet-fed press according to this invention has a sheet guide space between the printing cylinder and a sheet guide unit, and it would prevent specially the end of the sheet from flapping or fluttering in the downstream portion of its travel through the sheet guide space.

To solve this problem, this invention will disclose the sheet guide unit provided for a sheet-fed press which has a first printing cylinder, such as an intermediate or delivery cylinder below which is fashioned a curved guide surface separated by a small space from the surface of the cylinder; and a second printing cylinder, such as an impression cylinder or the like which is positioned quite close to the first cylinder so that the reception unit for the sheet is between the two cylinders. The sheet guide unit according to this invention is distinguished by the following features. It has one or more air supply chambers, which are behind the curved sheet guide surface in the upstream portion of the path traveled by the sheet; and an aspiration chamber behind the curved sheet guide surface adjacent to the air supply chamber in the downstream portion of the sheet traveling path; a first air control means to control the supply air, which is blown from the air supply chamber through air vents provided in the upstream portion of the path, and conveys the sheet through the sheet guide space suspending over the downstream portion of the path; a second air control means to control the aspiration air, which is drawn into the aspiration chamber via the numerous first aspiration vents in the downstream portion of the path, and exhausted from the aspiration port provided on one of the walls of the aspiration chamber which is not the sheet guide surface.

With this invention, different means are used to control the air stream on the upstream and downstream portions of the sheet guide surface as the sheet is conveyed. This scheme insures that a sheet of a thinner stock will be conveyed smoothly even when the press uses a skeleton cylinder.

In the upstream portion of the sheet traveling path through the sheet guide space over the sheet guide surface, as can be seen in prior art designs, a difference in the flow velocity of the air stream above and below the sheet cause the Bernoulli effect to occur. This causes the sheet being conveyed along the surface of the intermediate cylinder to be drawn toward the surface of the sheet guide and suspended slightly above it, thus enabling the sheet to be conveyed smoothly without flapping.

In the downstream portion of the path traveled by the sheet through the guide space over the sheet guide surface, there is nothing mechanical to hold the sheet once it is released by the pawls of the skeleton-type intermediate cylinder. It is instead held by the negative pressure created by the set of first aspiration vents which extend across the entire width of the sheet guide surface, and which communicate with the aspiration chamber. Once the sheet is released from the grip of the pawls, it is drawn toward the surface of the sheet guide unit in the downstream portion of the path it travels through the guide space, which has numerous aspiration vents running across it.

Thus even when a sheet of a thinner stock is being printed using a skeleton cylinder, when the end of the sheet is released by the pawls of the skeleton cylinder in the downstream portion of the sheet's path, it will always be drawn toward the surface of the sheet guide by the negative pressure generated by the suction of the first aspiration vents. This will prevent the end of the sheet from flapping or buckling.

In both the upstream and downstream portions of the sheet guide unit, then, the sheet will be transferred smoothly from the intermediate cylinder in question to the next printing cylinder. Sheets of thinner stocks will be conveyed in a stable fashion. Thinner sheets, then, can be printed smoothly even when a skeleton cylinder, which is more suitable for thicker stocks, is used, and printing defects can be prevented.

Another embodiment of this invention comprises a sheet guide in a sheet-fed press which has on the outlet end of the sheet guide unit a series of air passages consisting of cut-away portions through which the pawls of the printing cylinder can pass. In the downstream portion of the sheet guide unit mentioned above, a space (hereafter referred to as "aspiration space") is provided which faces the surface of the second printing cylinder. The air which flows through the air passages along with the air drawn into the aspiration chamber through the first aspiration vents is drawn into the aspiration chamber, and then exhausted via the aspiration port.

Even though it is possible for turbulence to occur in the air stream flowing through the sheet guide space and the intervals provided on the outlet end of the sheet guide unit to accommodate the pawls of the printing cylinder, this air is constantly sucked into the aspiration chamber before the turbulence can reach a significant level. This arrangement prevents the end of the sheet from flapping or buckling, and the sheet is transferred to the next printing cylinder without hindrance.

Another feature of this invention is that an air volume adjustment means is provided by which the volume of air drawn into the aspiration chamber via the first array of vents in the downstream portion of the sheet guide can be controlled. By this means, a portion of the air exhausted from the aspiration chamber can be returned to the same chamber.

This insures that the suction provided will never be sufficient to impede the passage of the sheet through the downstream segment of the sheet guide unit, but will be sufficient to keep the end of the sheet from flapping or buckling so that it can be conveyed smoothly.

The aspiration port of the second air control means comprises a recirculation path which connects the aspiration chamber and the air supply chamber. The air may be recirculated along this path with the help of a recirculation pump installed on the path.

With this invention, the air which is continuously recirculated through the recirculation channel is also the air which flows through the sheet guide space. This scheme insures a smooth flow of air and makes it more unlikely that eddies will form. The sheet moves through the guide space in a stable fashion, and the air recirculation pump can be used to move the air along both the main and the recirculation paths, thus reducing the equipment cost.

As was discussed previously, if the system is configured in such a way that a portion of the air driven by the recirculation pump can be returned to the aspiration chamber, it will be possible to adjust the volume of air sucked into the aspiration chamber through the first aspiration vents in the downstream portion of the sheet guide unit.

The first aspiration vents on the sheet guide surface should be divided into two subsets by an imaginary line drawn from side to side through the midpoint of the sheet guide. As they proceed to the sides of the sheet, these rows of vents should all shift slightly upstream or downstream with respect to the path of the sheet such that the phase of each row is shifted slightly from that of the previous row.

For example, the aspiration vents in the very center of the guide might be shifted slightly upstream from the vents on the lateral sides of the guide. Then the center of the tail end of the sheet moving through the sheet guide space will leave the vents before the sides do. Since the sides of the sheet leave the vents last, this scheme is well suited for use with thinner stocks of paper, as they are liable to experience flapping and buckling on the sides of the sheet.

If the aspiration vents on the sides of the guide are shifted slightly upstream from the vents in the center, the sides of the end of the sheet moving through the space will leave the vents before the center does. Since the center of the sheet leaves the vents last, this scheme is well suited for use with thicker stocks of paper, as they are liable to experience flapping and buckling in the middle of the sheet.

Another feature of this invention is that the aspiration chamber is divided into several chambers by partitions at intervals along the width of the sheet guide. Then the ability to alter the volume of the air aspirated into each of the sub-chambers or cut it off completely constitutes a control means to control the volume of air aspirated.

With this invention, the valves which constitute the control means can be adjusted to change the pressure (i.e., the negative pressure) along the width of each chamber. This, in effect, adjusts the suction along the width of the sheet guide, allowing the position of the sheet to be controlled along its width. This insures that the sheet will maintain the same position and will not shift toward one side or the other as it travels.

Yet another embodiment of this invention for the sheet guide unit has a series of openings at intervals through which air can pass provided at the outlet end of the sheet guide surface as disclosed in claim 2. The embodiment is distinguished by the fact that a second aspiration vents, into which the air flowing through the openings is sucked, is provided on the wall of the aspiration chamber facing the surface of the second printing cylinder. This air, along with the air sucked into the aspiration chamber via the first aspiration vents, is exhausted via the aspiration port.

With this invention, the air in the aspiration space near the outlet end of the sheet guide unit is sucked into the aspiration chamber through the second aspiration vents. This creates an air stream in the aspiration space with a velocity component in the direction of the second aspiration vents. The resulting Bernoulli effect generates a negative pressure in the aspiration space.

This negative pressure pulls the end of the sheet toward the surface of the downstream portion of the sheet guide unit. Even at the very end of the sheet guide space, then, the end of the sheet is prevented from flapping or buckling.

Another preferred embodiment of this invention is a sheet guide unit for a sheet-fed press in which the outlet end of the sheet guide surface has a series of openings at intervals through which air can pass as disclosed in claim 2. The invention here implemented is distinguished by the following. In this sheet guide unit, a hood is provided over the rotary surface of the second printing cylinder, which is below the end of the sheet guide unit. The hood is adjacent to the wall in the downstream portion of the aspiration chamber which faces the surface of the second printing cylinder. The third aspiration vent which communicates with the aspiration chamber and the hood is provided in the downstream wall of the aspiration chamber. On the bottom of the hood an aspiration vent is provided. The air which enters the sheet guide space via the air passages at the end of the guide as well as the air sucked in the hood from the aspiration chamber through the third aspiration vents is sucked out via the hood.

With this invention, the air in the vicinity of the reception unit is collected and sucked into the hood. This prevents the air from dispersing and exerting an undesired influence on the passage of the sheet. The sheet can be handed of f from one printing cylinder to the next all the more smoothly.

As was mentioned previously, the system should be designed so that the air which ends up in the hood can be recirculated by means of a pump installed on the aspiration and recirculation path to both the supply chamber and the aspiration chamber.

DETAILED DESCRIPTION OF THE PREFERRED EMBODIMENTS

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration.

Figure 1:
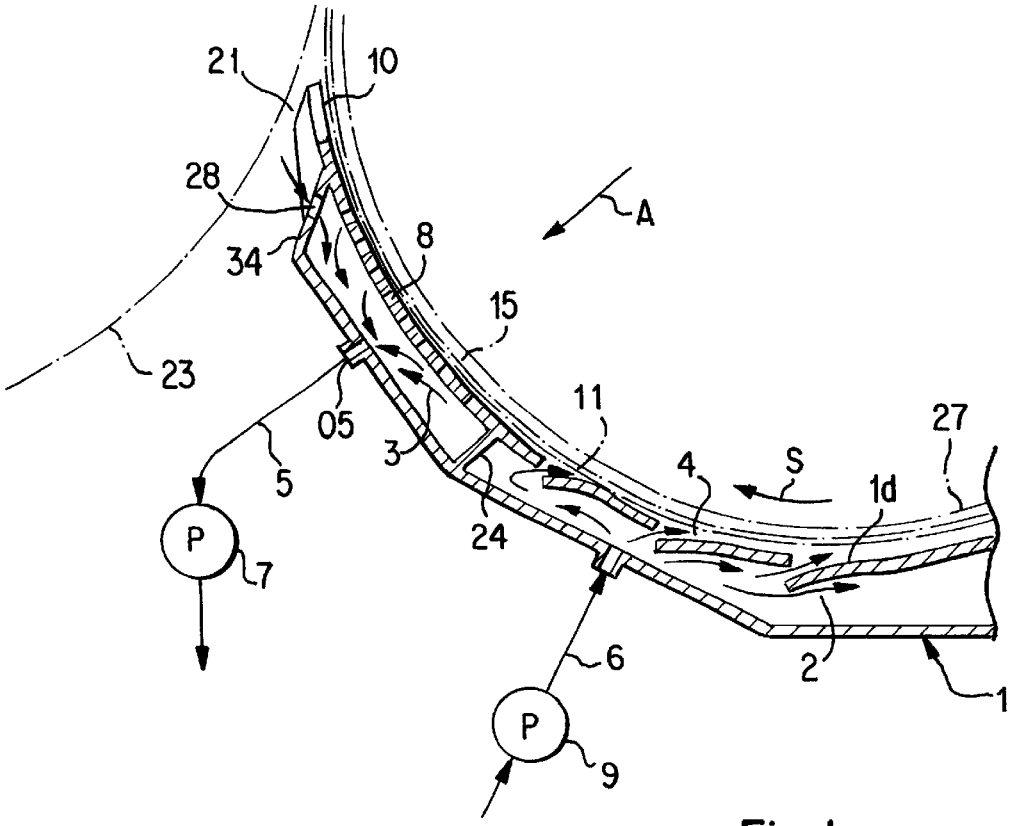
FIG. 1 is a cross section of the main parts of the sheet guide unit which is the first preferred embodiment of this invention.
Figure 2:
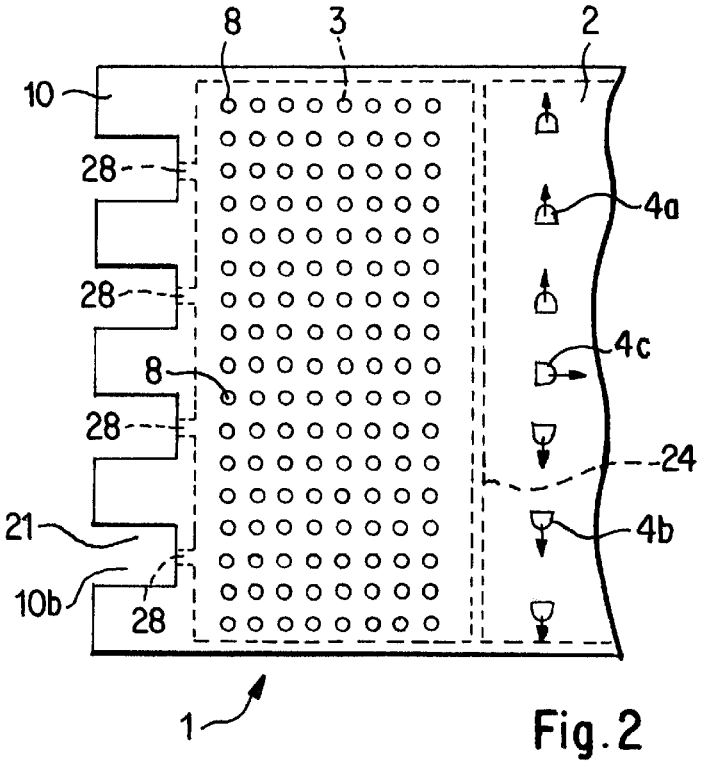
FIG. 2 shows the view from arrow A in FIG. 1.

FIG. 1 is a cross section of the main parts of the sheet guide unit 1 which is the first preferred embodiment of this invention. FIG. 2 shows the view from arrow A in FIG. 1.

As can be seen in FIG. 1, this embodiment concerns sheet guide 1, whose sheet guide surface 1*d* conforms to the shape of the bottom of intermediate cylinder 27 or delivery cylinder 35 (hereafter referred to collectively as "the intermediate cylinder"). In this embodiment the intermediate cylinder is a skeleton cylinder; the invention, of course, could also be applied to a drum cylinder. 23 is the impression cylinder. 21 is the air aspiration space below the downstream end of sheet guide surface 1*d* between the intermediate cylinder 27 and impression cylinder 23.

Sheet guide unit 1 contains sheet guide space 15, the space between the curving upper sheet guide surface id of the sheet guide and the lower surface of the intermediate cylinder 27 through which the air stream travels. Behind sheet guide surface Id of the sheet guide unit 1, in the upstream portion of the sheet's path only, is an air supply chamber 2, which may be divided into several chambers to the left and right of a central partition. 4 are the air vents in the upstream portion of sheet guide surface Id which are located above the air supply chamber 2. As can be seen in FIG. 2, vent 4*c*, located on the axis of the intermediate cylinder 27, connects the sheet guide space 15 with the air supply chamber 2. Vent 4*c* is aimed upstream, i.e., opposite the direction in which the sheet travels. The vents on either side of it, 4*a* and 4*b*, face away from each other toward the sides of the intermediate cylinder 27. Streams of air are blown out of the vents 4 to keep the sheet in the proper position so as to stabilize its travel.

Figure 11A:
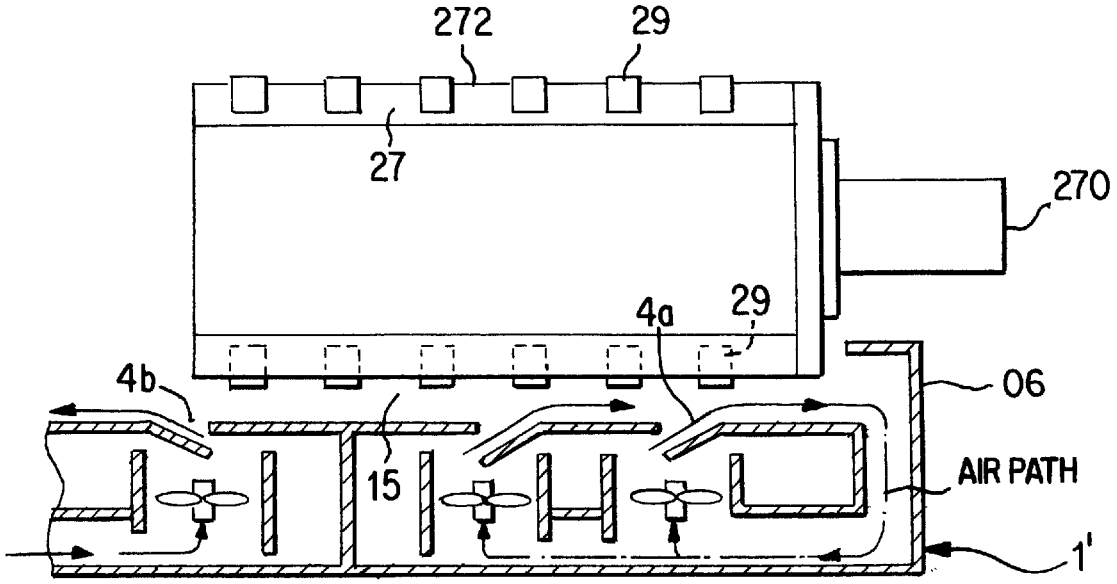
Fig. 11(A) PRIOR ART
FIG. 11 (A) is a cross section viewed from arrow A—A in FIG. 10, and (B) is a configuration of sheet guide surface of the sheet guide unit.
Figure 11B:
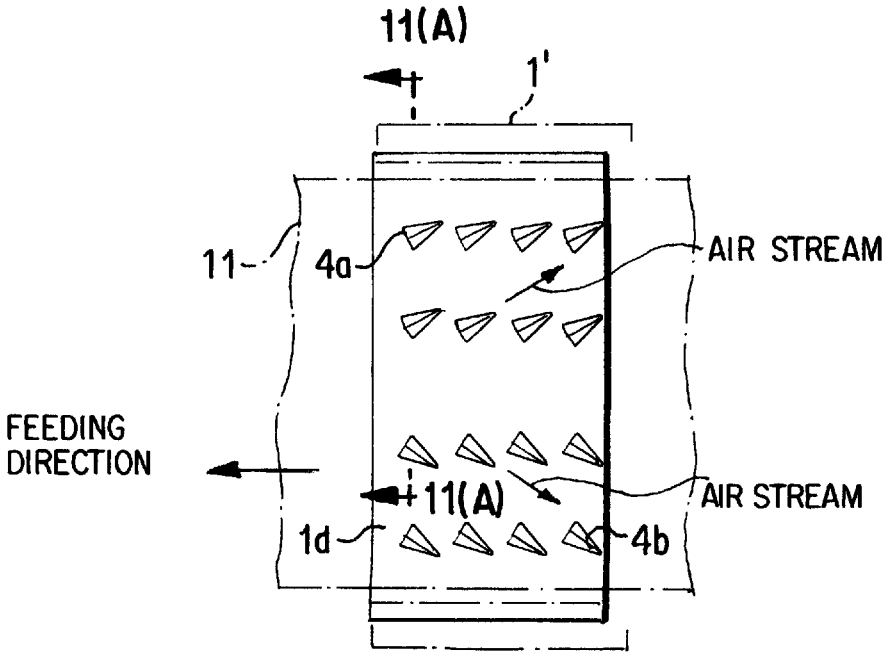
Fig. 11(B) PRIOR ART

The air supply chamber 2 and vents 4 are configured just as in the prior art, so we shall omit further explanation. Sheet guide space 15, between sheet guide surface 1*d* of the sheet guide unit and intermediate cylinder 27, has an air supply chamber 2 behind it. As the sheet moves through the upstream portion of the sheet guide, when it is still gripped by pawls 29 of skeleton-type intermediate cylinder 27, air is blown along surface 1*d* below the sheet through vents 4, which are arrayed along the width of the cylinder or face the direction of flow. The difference in the velocity of the air stream above and below the sheet causes the Bernoulli effect to occur so that the sheet being conveyed along the surface of the intermediate cylinder 27 is drawn toward sheet guide surface id of the sheet guide unit and suspended slightly above it as it travels. The air vents 4 need not be arranged or aimed as shown in FIG. 2 or 11 (B), but may be designed as necessary.

As is shown in FIG. 2, in order to guide the paper better, the outlet end of the sheet guide unit in the downstream segment of the sheet's path indicated by arrow S in FIG. 1 is fashioned so as to minimize the gap between it and impression cylinder 23. For this reason it has an indented portion 10 along its width through which the pawls can pass. These indented portion 10 has passages lob through which the air can flow. (Indentations lob may be provided at regular or irregular intervals.)

In the sheet guide unit' 1 of this embodiment, an aspiration chamber 3 is provided behind the downstream portion of sheet guide surface 1*d*. This chamber extends from wall 24 of the first air supply chamber 2 to the base of indented portion 10. More specifically, aspiration chamber 3 is created by walling off the downstream portion of chamber 2 with wall 24. The wall 34 on the outlet side of the aspiration chamber 3 faces air aspiration space 21 located between the intermediate cylinder 27 and impression cylinder 23.

6 is a supply pipe which is connected to the air supply chamber 2. 6 is the air supply pump installed on the supply pipe 6.

8 are a first set of numerous airholes which communicate with the aspiration chamber 3. They are distributed over the entire downstream portion of the sheet guide surface 1*d*. As can be seen in FIG. 2, the array of airholes 8 face air aspiration space 15 of sheet guide unit 1. They are arranged at equal intervals in rows and columns across the entire area over air aspiration chamber 3.

The air aspiration chamber 3 also has a second set of airholes 28 in wall 34, the wall which faces space 21 between the intermediate cylinder 27 and the next cylinder, impression cylinder 23. These holes 28 connect chamber 3 to the space 21. As can be seen in FIG. 2, a number of airholes 28 are provided along the width of sheet guide unit 1. More specifically, one air hole is provided in each indentation 10*b* of indented portion 10.

On the bottom of the aspiration chamber 3 are a number of aspiration ports 05. An aspiration pipe 5, on which an aspiration pump 7 is installed, is connected to each of the aspiration ports 05. The aspiration ports 05 and aspiration pipes 5 are provided across the width of sheet guide unit 1. All the aspiration pipes 5 flow into a common aspiration pipe, on which a single aspiration pump 7 is installed. In this way the air is sucked out of the aspiration chamber 3.

Figure 9:
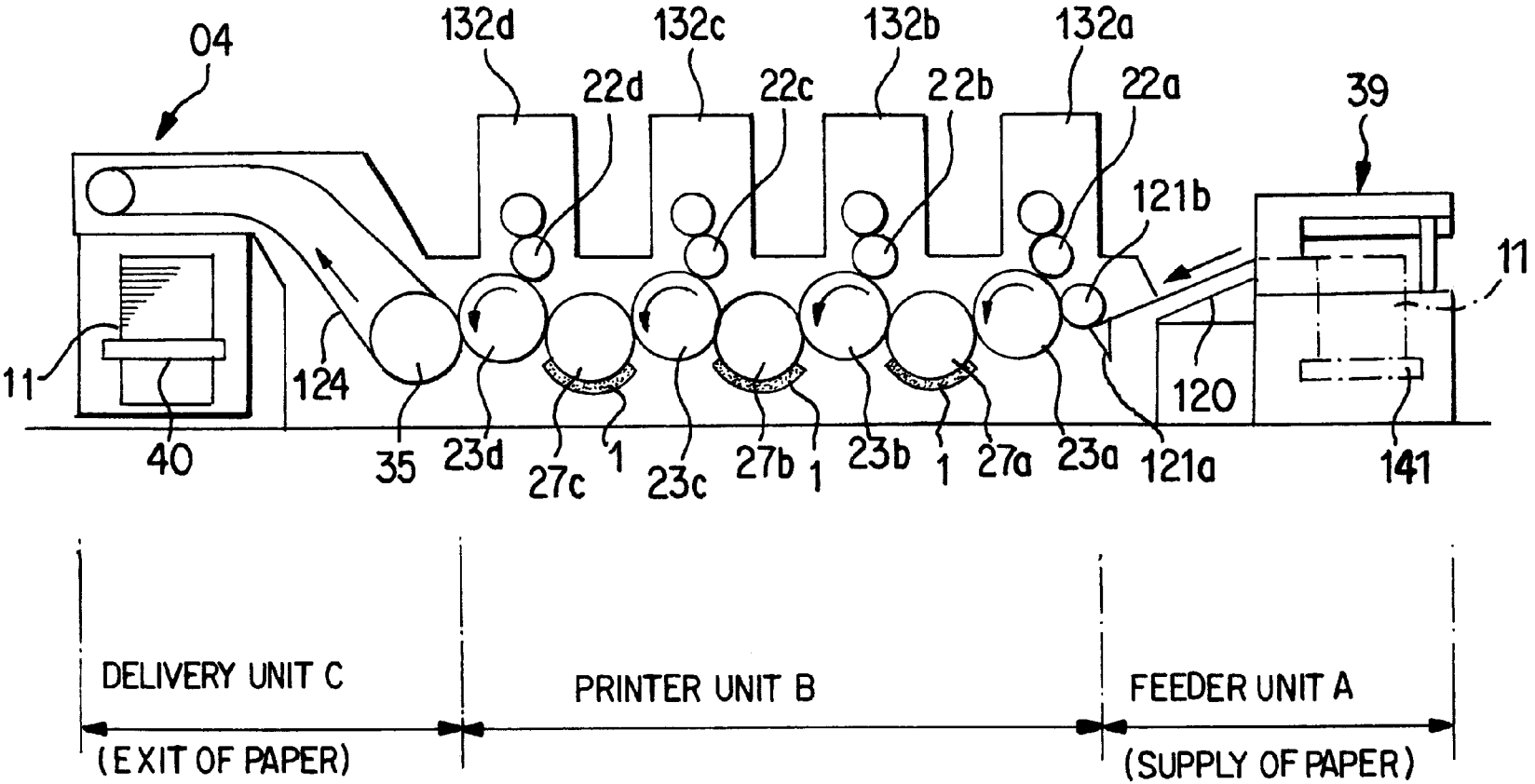
Fig. 9 PRIOR ART
FIG. 9 is a configuration of a sheet-fed press in which either a prior art sheet guide unit or the present invention can be used.
Figure 10:
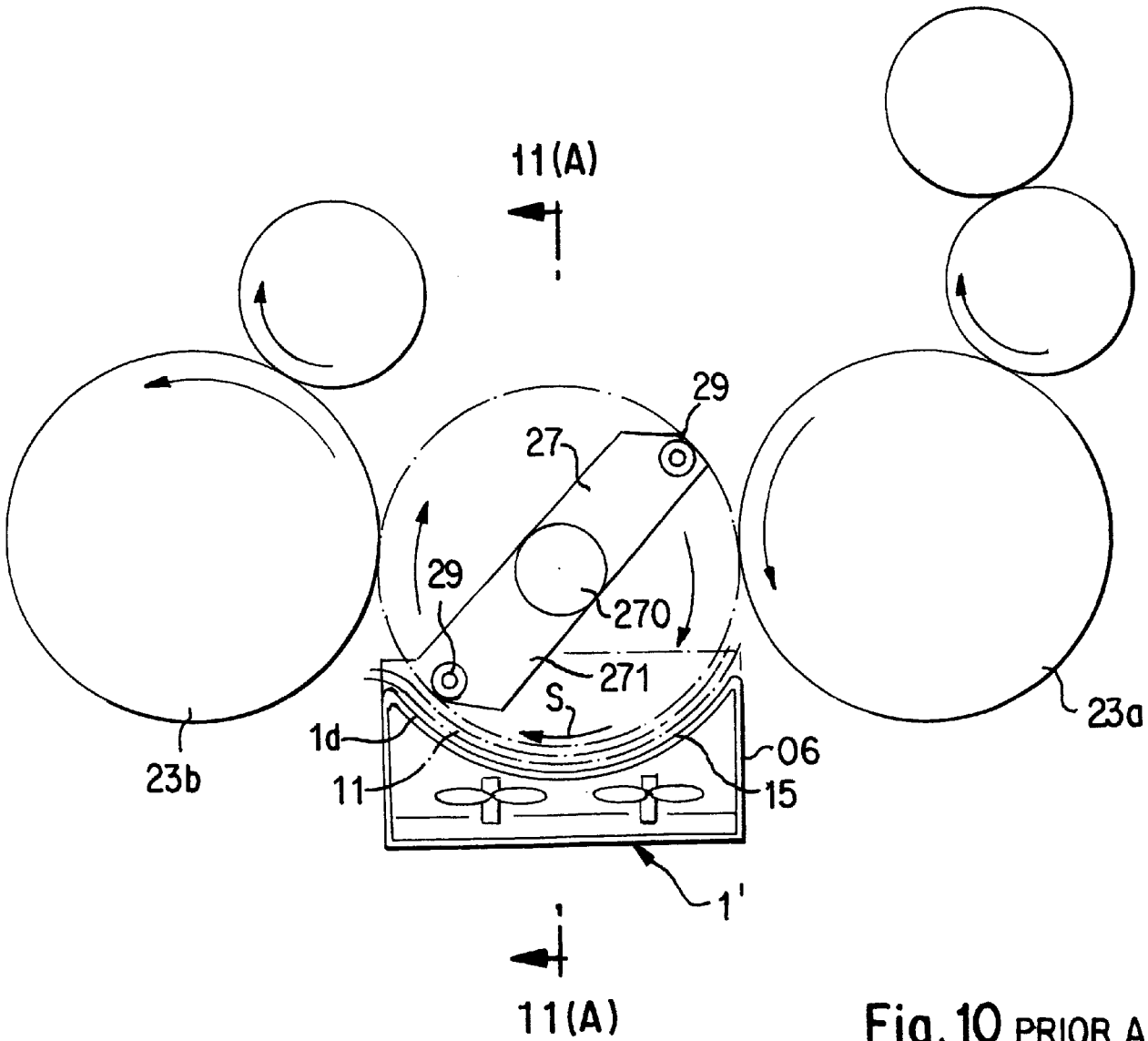
Fig. 10 PRIOR ART
FIG. 10 is a configuration of a skeleton-type intermediate cylinder and a vicinity of sheet guide unit according to the prior art.

In a sheet guide unit for a sheet-fed press configured in this way, the sheet 11 transported by the impression cylinder 23 (23*a*) is gripped by pawls 29 of the skeleton-type intermediate cylinder 27 (27*a*) as can be seen in FIGS. 9 and 10. It then passes through sheet guide space 15, which is between the intermediate cylinder 27 and the sheet guide 1.

Air which has been pressurized to the required pressure is supplied by the supply pump 9 via the supply pipe 6 to air supply chamber 2, which is in the upstream portion of the path S traveled by the sheet through the sheet guide 1. The air which accumulates in the air supply chamber 2 is blown through vents 4 along the bottom of the sheet 11 which is passing through the sheet guide space 15.

As intermediate cylinder 27 rotates, the sheet 11 is drawn toward surface 1*d* of sheet guide 1, the surface where the pressure is reduced by the air stream. It passes through the sheet guide space 15 while suspended a specified distance above the sheet guide surface 1*d*.

Once sheet 11 has passed over the upstream portion of the sheet guide surface Id, and particularly if it is a thinner sheet, its behavior will become unstable when its back end is released from the grip of pawls 29 of the skeleton-type intermediate cylinder 27 (27*a*). It is liable to flap or buckle when it enters air aspiration space 21 near indented portion 10 of the sheet guide unit 1.

In this embodiment, airholes 8, which connect with the aspiration chamber 3, are provided all across the downstream portion of the path S traveled by the sheet in the guide space 15 of the sheet guide 1. Also, the suction of the aspiration pump 7 maintains a negative pressure in the aspiration chamber 3. The areas near airholes 8 in the sheet guide space 15 also experience a negative pressure. This causes sheet 11 to be drawn toward sheet guide surface 1*d* of sheet guide unit 1 in the downstream portion of the path S traveled by the sheet through the sheet guide space 15, which is connected by the numerous airholes 8 to air aspiration chamber 3.

In the downstream portion of the path S traveled by the sheet 11 through sheet guide space 15, when the end of the sheet is released by pawls 29 of skeleton-type intermediate cylinder 27 (27*a*), the flow of air through the holes 8 creates a negative pressure which draws the end of the sheet without fail toward sheet guide surface 1*d* of sheet guide unit 1. This prevents the end of the sheet 11 from flapping or buckling.

The air near indentations 10*b* of indented portion 10 at the downstream end of the sheet guide surface 1*d* is drawn into the aspiration chamber 3 through the second array of airholes 28 in the wall of sheet guide 1 which faces the air aspiration space 21. This causes an air stream to be created in the vicinity of indentations lob of the indented portion 10 with a velocity component in the direction of the second array of airholes 28. The air stream causes the Bernoulli effect to occur, generating a negative pressure in the vicinity of indentations 10*b* of indented portion 10, and drawing the end of sheet 11 toward the indented portion of the sheet guide unit 1. Thus even at the very end of the downstream portion of the sheet guide space 15, the end of sheet 11 is prevented from flapping or buckling.

This insures that the sheet 11 can be transferred smoothly from the intermediate cylinder 27 to the next cylinder, impression cylinder 23.

Figure 3:
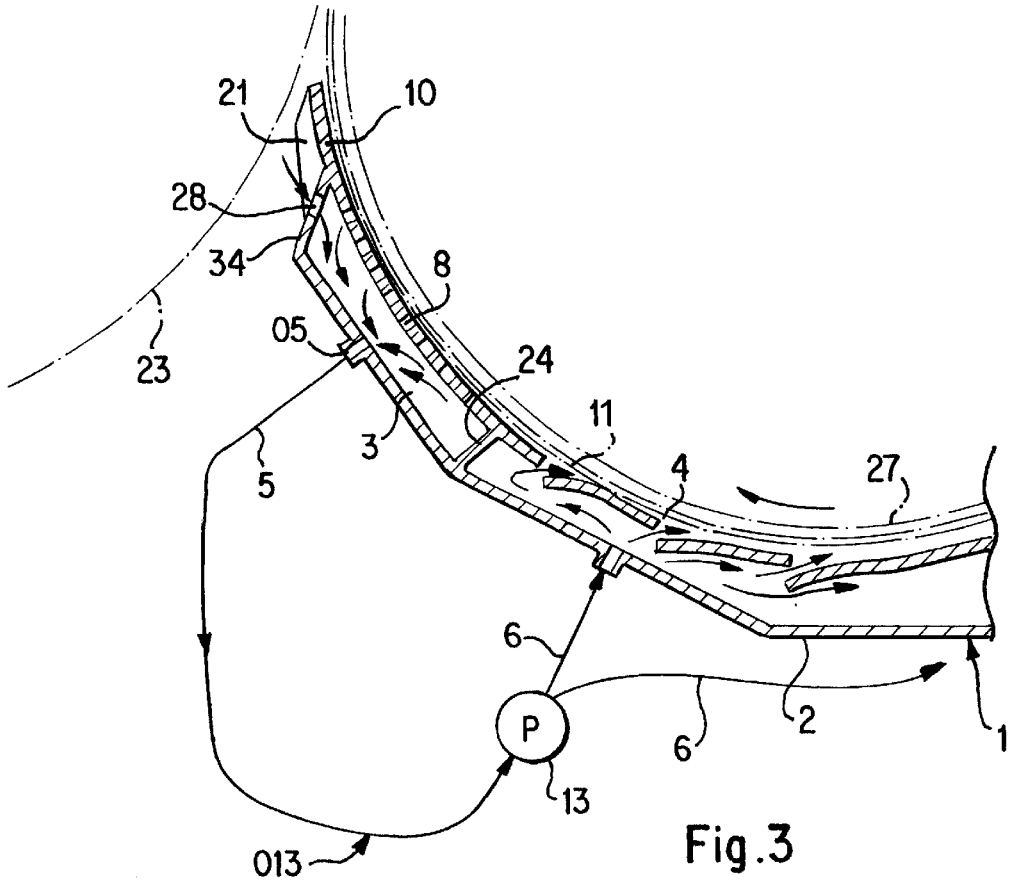
FIG. 3 is a view of the second preferred embodiment of this invention which corresponds to FIG. 1.

FIG. 3 is a view of the second preferred embodiment of this invention which corresponds to FIG. 1.

In the second preferred embodiment shown in FIG. 3, aspiration pipe 5, which is connected to aspiration port 05 of the air aspiration chamber 3, and supply pipe 6, which is connected to the air supply chamber 2, are connected to each other to form recirculation channel 013. A recirculation pump 13 is provided in the recirculation channel 013. The recirculation pump 13 sucks the air out of the air aspiration chamber 3 and supplies it to the one or more air supply chambers 2 located behind the downstream segment of sheet guide surface 1*d*.

With this embodiment, the air which continuously recirculates via the recirculation channel 013 flows through the sheet guide space 15. This insures that there will be a smooth airflow and makes it more difficult for turbulence to develop. It allows sheet 11 to be conveyed in a stable fashion through the sheet guide space 15. And since it requires only one recirculation pump 13, this scheme also reduces the equipment cost.

The rest of the configuration is identical to that of the first embodiment. Corresponding components have been labeled with the same numbers.

Figure 4:
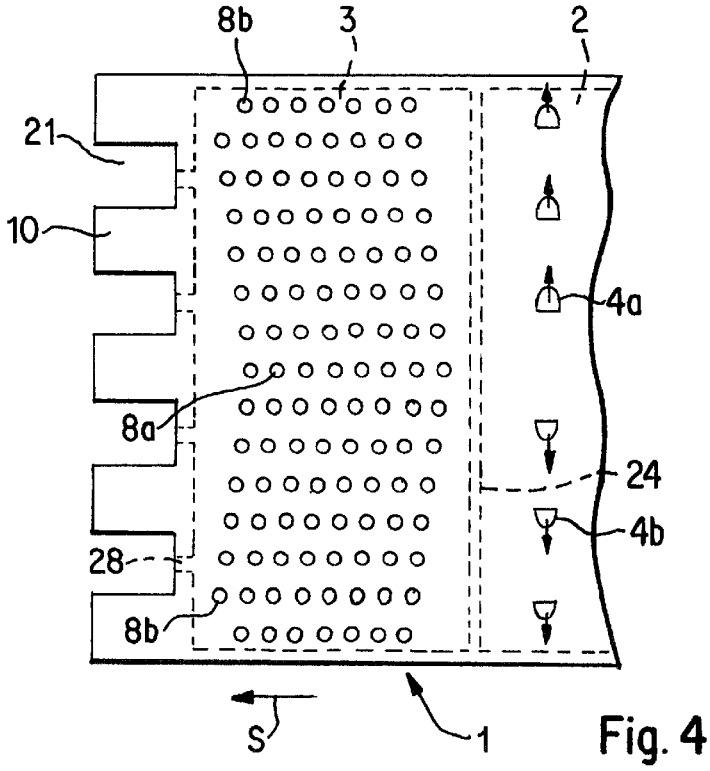
FIG. 4 is a view of the third preferred embodiment of this invention which corresponds to FIG. 2.

FIG. 4 is a view of the third preferred embodiment of this invention which corresponds to FIG. 2.

In the third embodiment pictured in FIG. 4, the array of airholes 8 in the sheet guide unit 1 is arranged along the width of the sheet guide unit 1 in such a way that row 8*a* in the center of the guide is slightly upstream, in terms of the path S traveled by the sheet, from the rows 8*b* on either side of it, with each row going outward shifted slightly downstream from the preceding one.

With this embodiment, the center of the tail end of the sheet 11 moving through the sheet guide space 15 will leave the airholes 8*a* before the sides leave the airholes 8*b* on either side of the center. Since the sides of the sheet leave airholes 8*b* last, this scheme is effective for thinner stocks of paper, as they are liable to experience flapping and buckling on the sides of sheet 11.

The rest of the configuration is identical to that of the first embodiment. Corresponding components have been labeled with the same numbers.

Figure 5:
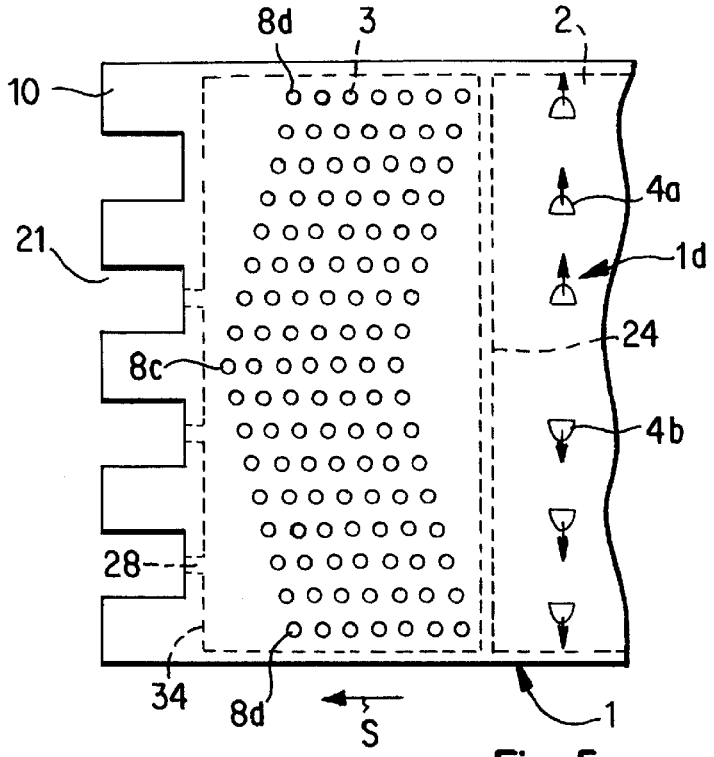
FIG. 5 is a view of the fourth preferred embodiment of this invention which corresponds to FIG. 2.

FIG. 5 is a view of the fourth preferred embodiment of this invention which corresponds to FIG. 2.

In the fourth embodiment pictured in FIG. 5, the array of airholes 8 in the sheet guide 1 is arranged along the width of the sheet guide 1 in such a way that rows 8d on either side of the guide are slightly upstream, in terms of the path S traveled by the sheet, from row 8*c* in the center, with each row going outward shifted slightly upstream from the preceding one.

With this embodiment, the sides of the tail end of the sheet 11 moving through the sheet guide space 15 will leave the airholes 8d before the center leaves the airholes 8*c*. Since the center of the sheet leaves airholes 8*c* last, this scheme is effective for softer or thicker stocks of paper, as they are liable to experience flapping and buckling in the center of sheet 11.

The rest of the configuration is identical to that of the first embodiment. Corresponding components have been labeled with the same numbers.

Figure 6:
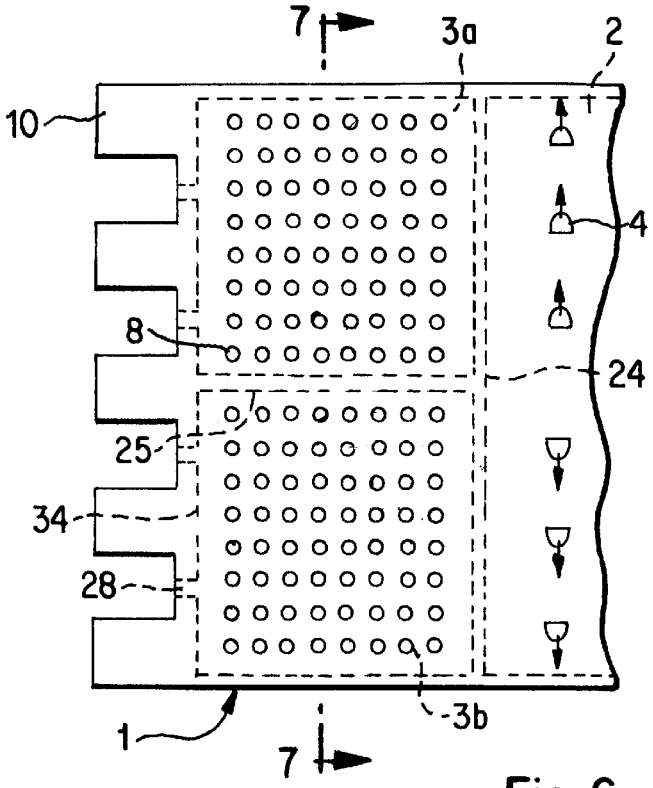
FIG. 6 is a view of the fifth preferred embodiment of this invention which corresponds to FIG. 2.
Figure 7:
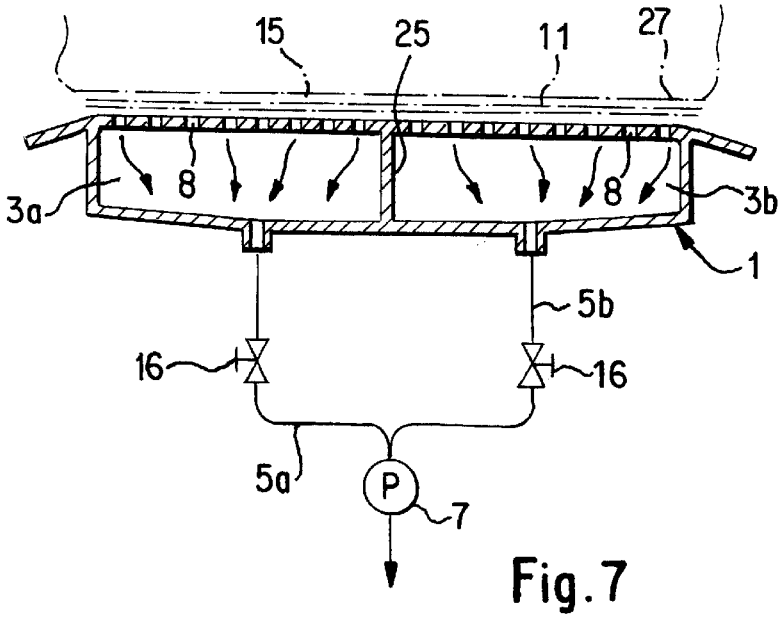
FIG. 7 is a cross section taken along line B—B in FIG. 6.

FIG. 6 is a view of the fifth preferred embodiment of this invention which corresponds to FIG. 2. FIG. 7 is a cross section taken along line B—B in FIG. 6.

In the fifth embodiment shown in FIGS. 6 and 7, the air aspiration chamber 3 is divided by partition 25 into two aspiration chambers, 3*a* and 3*b*, along the width of sheet guide unit 1. (It could also be divided into three or more chambers.) Aspiration pipes 5*a* and 5*b* are connected to air aspiration chambers 3*a* and 3*b*, respectively. The aspiration pipes 5*a* and 5*b* come together and connect to the aspiration port of aspiration pump 7. Each of aspiration pipes 5*a* and 5*b* has a valve 16 which opens and closes or adjusts the partial opening of that pipe to control the flow of air.

With this embodiment, adjusting the opening of the control valves 16 adjusts the pressure (i.e., the negative pressure) in air aspiration chambers 3*a* and 3*b* which lie along the width of the sheet guide unit 1. When the pressure in the aspiration chambers 3*a* and 3*b* is changed, the suction which pulls sheet 11 all across sheet guide 1 is adjusted. This allows us to control the position of sheet 11 with respect to the sides of sheet guide unit 1. This insures that the sheet will maintain the same position and will not shift toward one side or the other as it travels.

The rest of the configuration is identical to that of the first embodiment. Corresponding components have been labeled with the same numbers.

Figure 8:
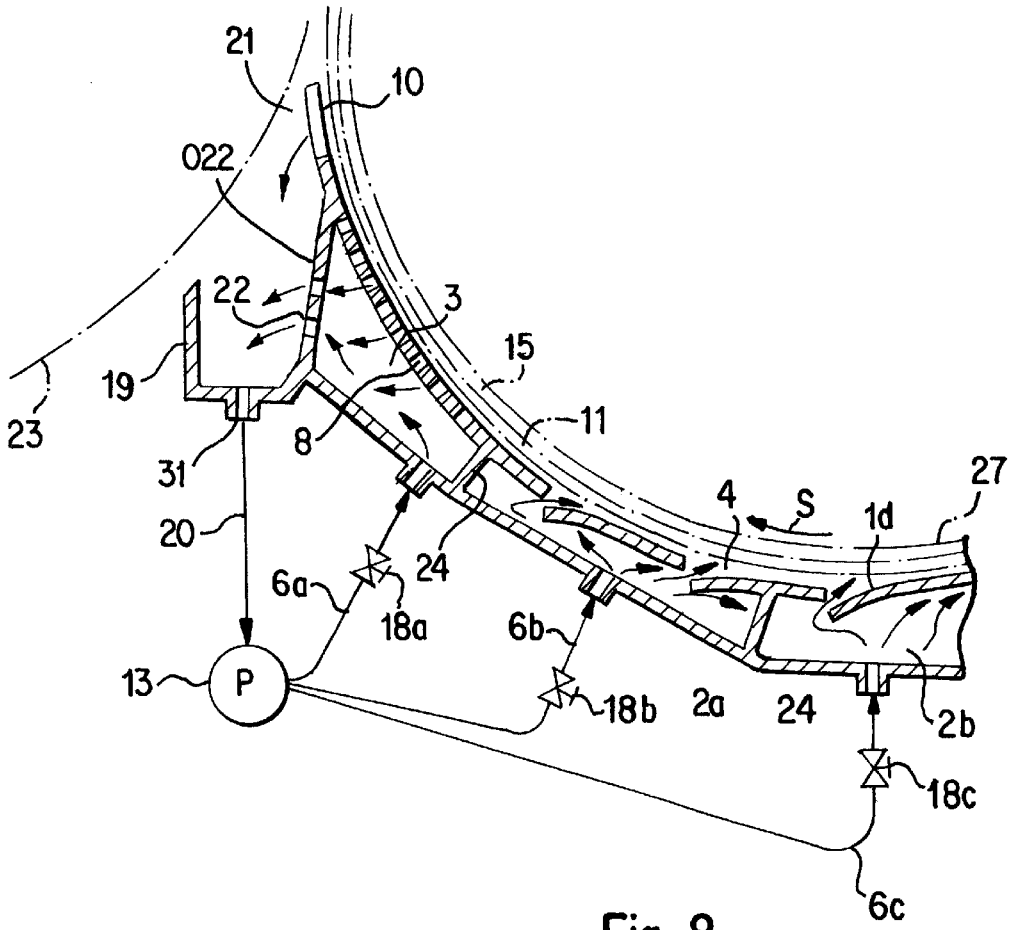
FIG. 8 is a view of the sixth preferred embodiment of this invention which corresponds to FIG. 1.

FIG. 8 is a view of the sixth preferred embodiment of this invention which corresponds to FIG. 1.

In the sixth preferred embodiment pictured in FIG. 8, air supply pipe 6*a*, which has a valve 18*a* on it, is connected to the bottom of the air aspiration chamber 3 nearer the upstream end of the path S traveled by the sheet. There is an exhaust vent 22 in wall 022 of the air aspiration chamber 3 downstream from the air supply pipe 6*a* with reference to the path S traveled by the sheet.

A hood 19 whose cross section is shaped like an angular letter "J" opens onto the surface of the impression cylinder below indented portion 10 on the downstream end of sheet guide surface 1*d* adjacent to the wall 022. The air stream from indented portion 10 will be sucked into the hood via air aspiration space 21. The hood 19 runs across the entire width of the sheet guide. It opens onto the surface of the impression cylinder 23 and covers the space directly below it.

A number of exhaust ports 31 are provided on the bottom of the hood 19. The aspiration ports 31 are provided at fixed intervals across the width of sheet guide unit 1 so as to create uniform suction all across the guide. The air in the hood 19 is exhausted through exhaust port 31 and aspiration pipe 20 with the help of recirculation pump 13. The pipe on the forward side of the pump 13 branches and connects to air supply pipe 6*a*, which runs into the air aspiration chamber 3, and air supply pipes 6*b* and 6*c*, which run into the air supply chambers 2*a* and 2*b*, respectively. 18*b* and 18*c* are valves which open and close the air supply pipes 6*b* and 6*c*, respectively.

With this embodiment, opening valve 18*a* of the air supply pipe 6*a* and operating recirculation pump 13 creates the recirculation path indicated by arrows in FIG. 8. This path runs from the recirculation pump 13 through air supply pipe 6a, air aspiration chamber 3, exhaust vent 22, hood 19 and aspiration pipe 20 back to recirculation pump 13. The suction created by the air stream on this recirculation path pulls the air in the vicinity of the passages in the indented portion 10 into hood 19. This air joins the stream from the air aspiration chamber 3, which is sucked toward the recirculation pump 13.

The forward side of the recirculation pump 13 branches, and one branch is connected to aspiration chamber 3 through valve 18*a*. By adjusting the valve 18*a*, we can return a portion of the air exhausted from the aspiration chamber 3 to the same chamber. This allows us to adjust the volume of air pulled into the air aspiration chamber 3 through airholes 8 in the downstream segment of sheet guide surface 1*d*.

This insures that the suction provided will never be sufficient to impede the passage of the sheet through the downstream segment of the sheet guide, but will be sufficient to keep the end of the sheet from flapping or buckling so that it can be conveyed smoothly.

With this embodiment, then, the air is recirculated along a path which goes from the recirculation pump 13 through air aspiration chamber 3 and hood 19 and back to recirculation pump 13. The air stream created by this path acts as an ejector, sucking the air in the vicinity of the indented portion 10 into hood 19. This maintains a negative pressure in the air aspiration space 15 along the entire downstream portion of the sheet guide unit, from the area above air aspiration chamber 3 to the vicinity of indented portion 10. This allows the sheet 11 to be conveyed smoothly and prevents the end of the sheet from flapping or buckling.

The rest of the configuration is identical to that of the first embodiment. Corresponding components have been labeled with the same numbers.

In the embodiments, the sheet guide units are installed on intermediate cylinder 27. The invention may also be implemented as a sheet guide for the delivery cylinder or the printing cylinder. Even when a skeleton cylinder is used with sheets of thinner stocks, when the end of the sheet is released from the pawls of the skeleton-type intermediate cylinder, the negative pressure generated by the suction through the airholes will pull the end of the sheet toward the surface of the sheet guide. It will thus be prevented from flapping and buckling.

The sheet, then, will be transferred smoothly from the intermediate cylinder in question to the next printing cylinder. Sheets of thinner stocks will be conveyed in a stable fashion. Thinner sheets can be printed smoothly even when a skeleton cylinder, which is more suitable for thicker stocks, is used, and printing defects can be prevented.

What is claimed is:

1. A sheet guide unit provided for a sheet-fed press which has a first printing cylinder below which is fashioned a curved guide surface separated by a small sheet guide space from the surface of the first printing cylinder, and a second printing cylinder which is positioned close to the first printing cylinder so that a reception unit for the sheet is provided between the two cylinders, comprising:

one or more air supply chambers, which are behind the curved sheet guide surface in an upstream portion of a sheet traveling path;

an aspiration chamber behind the curved sheet guide surface adjacent to said air supply chamber in a downstream portion of the sheet traveling path;

a first air control means to control the supply air, which is blown from the air supply chamber through air vents provided in the upstream portion of the path, and conveys the sheet through the sheet guide space suspending over the downstream portion of the path; and a second air control means to control the aspiration air, which is drawn into the aspiration chamber via a plurality of first aspiration vents in the downstream portion of the path, and exhausted from an aspiration port provided on a wall of the aspiration chamber which is not the sheet guide surface.

2. A sheet guide unit according to claim 1, further comprising:

a plurality of air passages on an outlet end of the sheet guide surface including cut-away portions through which pawls of the first printing cylinder can pass; and an aspiration space in a downstream portion of the guide surface, which faces a surface of the second printing cylinder;

wherein the air which flows through said air passages along with the air drawn into said aspiration chamber through said first aspiration vents is drawn into said aspiration chamber, and then exhausted via the aspiration port.

3. A sheet guide unit according to claim 2, further comprising second aspiration vents, into which the air flowing through said air passages is sucked, is provided on the wall of said aspiration chamber facing the surface of the second printing cylinder, thereby the air, along with the air sucked into said aspiration chamber via said first aspiration vents, is exhausted via said aspiration port.

4. A sheet guide unit according to claim 2, further comprising:

a hood provided adjacent to the wall in the downstream portion of said aspiration chamber, which faces the surface of said second printing cylinder; and a third aspiration vent which communicates with said aspiration chamber and said hood, which is provided in the downstream wall of said aspiration chamber;

wherein the air which enters the sheet guide space via said air passages at the end of the guide as well as the air sucked in said hood from said aspiration chamber through said third aspiration vent is sucked out from the aspiration port provided on the bottom of said hood.

5. A sheet guide unit according to claim 4, further comprising a pump installed on the aspiration and recirculation path, wherein said air which ends up in the hood can be recirculated by means of the pump to both said air supply chamber and said aspiration chamber.

6. A sheet guide unit according to claim 1, further comprising an air volume adjustment means to control the volume of air drawn into said aspiration chamber via said first aspiration vents in the downstream portion of the sheet guide surface, thereby a portion of the air exhausted from said aspiration chamber is returned to said same chamber.

7. A sheet guide unit according to claim 1, wherein said aspiration port of the second air control means comprises a recirculation path which connects said aspiration chamber and said air supply chamber, thereby the air is recirculated along said recirculation path with the help of a recirculation pump installed on said path.

8. A sheet guide unit according to claim 7, wherein a portion of the air circulated by said recirculation pump can be returned to said aspiration chamber, thereby the volume of air drawn into said aspiration chamber via said first aspiration vents is controlled.

9. A sheet guide unit according to claim 1, wherein said first aspiration vents on the sheet guide surface are divided into two subsets by an imaginary line drawn from side to side through the midpoint of the sheet guide surface, and the rows of said first aspiration vents all shift slightly upstream or downstream with respect to the path of the sheet, thereby the phase of each row is shifted slightly from the phase of the previous row.

10. A sheet guide unit according to claim 1, wherein said aspiration chamber is divided into several sub-chambers by partitions at intervals along the width of the sheet guide surface, and said second air control means alters the volume of the air aspirated into each of said sub-chambers or cuts the air off completely.

11. A sheet guide unit for a sheet-fed press that has a first printing cylinder, a curved sheet guide surface having upstream and downstream portions in a sheet travel path, a sheet guide space separating the curved sheet guide surface from a surface of the first printing cylinder, and a second printing cylinder arranged relative to the first printing cylinder for receiving a sheet between the first and second printing cylinders, the sheet guide unit comprising:

at least one air supply chamber having air vents through the upstream portion of the curved sheet guide surface to provide fluid communication between the air supply chamber and the sheet guide space;

an aspiration chamber having aspiration vents through the downstream portion of the curved sheet guide surface to provide fluid communication between the aspiration chamber and the sheet guide space;

a first air control controlling air flow from the air supply chamber through the air vents to the sheet guide space to convey a sheet through the sheet guide space adjacent to the upstream portion of the curved sheet guide surface; and a second air control controlling aspiration air from the sheet guide space via the aspiration vents into the aspiration chamber, the air drawn into the aspiration chamber being exhausted from an aspiration port of the aspiration chamber.

12. A sheet guide unit according to claim 11, further comprising:

an aspiration space adjacent to the downstream portion of the sheet guide surface, which aspiration space faces the surface of the second printing cylinder;

wherein the aspiration chamber includes a plurality of air passages on an outlet end of the sheet guide surface, the outlet end including cut-away portions through which pawls of the first printing cylinder can pass; and wherein air flows from the aspiration space through the air passages into the aspiration chamber and is exhausted via the aspiration port of the aspiration chamber.

13. A sheet guide unit according to claim 12, further comprising additional aspiration vents, into which the air flowing through the air passages is sucked, on a wall of the aspiration chamber facing the surface of the second printing cylinder.

14. A sheet guide unit according to claim 12, further comprising:

a hood disposed adjacent to a wall of the aspiration chamber facing the surface of the second printing cylinder; and a further aspiration vent which provides fluid communication between the aspiration chamber and the hood;

wherein the air which the air sucked in the hood from the aspiration chamber through the further aspiration vent is sucked out from an aspiration port of the hood.

15. A sheet guide unit according to claim 14, further comprising a pump installed in the aspiration and recirculation path, wherein the air in the hood is recirculated by the pump to both the air supply chamber and the aspiration chamber.

16. A sheet guide unit according to claim 11, further comprising an air volume adjustment to control air flow into the aspiration chamber through the aspiration vents in the downstream portion of the sheet guide surface, thereby a portion of the air exhausted from the aspiration chamber is returned to the aspiration chamber.

17. A sheet guide unit according to claim 11, further comprising a recirculation path and a recirculation pump disposed in the recirculation path, the recirculation path connecting the aspiration port of the aspiration chamber to the air supply chamber, thereby air exhausted from the aspiration chamber is supplied to the air supply chamber through the recirculation path and the recirculation pump.

18. A sheet guide unit according to claim 17, wherein a portion of the air exhausted from the aspiration chamber is returned to the aspiration chamber, thereby air drawn into the aspiration chamber through the aspiration vents is controlled.

19. A sheet guide unit according to claim 11, wherein some of the aspiration vents in a middle region of the curved guide surface are shifted upstream or downstream with respect to the rest of the aspiration vents.

20. A sheet guide unit according to claim 11, wherein the aspiration chamber includes a plurality of sub-chambers along the width of the sheet guide surface, and the second air control alters air aspirated into the subchambers.

* * * * *